US011134341B1

(12) United States Patent
Tang et al.

(10) Patent No.: US 11,134,341 B1
(45) Date of Patent: Sep. 28, 2021

(54) SPEAKER-AS-MICROPHONE FOR WIND NOISE REDUCTION

(71) Applicant: MOTOROLA SOLUTIONS, INC., Chicago, IL (US)

(72) Inventors: Kar Meng Tang, Penang (MY); Kurt S. Fienberg, Plantation, FL (US); Geng Xiang Lee, Penang (MY); Lian Kooi Ng, Perak (MY); Thean Hai Ooi, Penang (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/865,900

(22) Filed: May 4, 2020

(51) Int. Cl.
*H04R 3/00* (2006.01)

(52) U.S. Cl.
CPC ..... *H04R 3/002* (2013.01); *H04R 2400/01* (2013.01); *H04R 2410/07* (2013.01)

(58) Field of Classification Search
CPC ..... H04R 3/002; H04R 2400/01; H04R 2410/07; H04R 2410/05
USPC ..... 381/56, 58–59, 94.5, 123, 91–92, 96
See application file for complete search history.

(56) References Cited

U.S. PATENT DOCUMENTS 7,171,008 B2 1/2007 Elko
7,181,030 B2 * 2/2007 Rasmussen ..... H04R 25/402 381/312
9,613,611 B2 * 4/2017 Ozluturk ..... G10K 11/17855
9,661,195 B2 * 5/2017 Jing ..... H04N 5/2252
9,807,501 B1 * 10/2017 Tisch ..... H04R 3/005
10,667,049 B2 * 5/2020 Ozcan ..... H04R 1/04
2008/0317261 A1 12/2008 Yoshida et al.
2011/0136438 A1 6/2011 Tan et al.
2016/0080864 A1 * 3/2016 Scarlett ..... G10L 21/0208 381/94.1
2017/0006195 A1 * 1/2017 Tisch ..... H04R 3/00
2018/0343514 A1 * 11/2018 Dusan ..... G10K 11/17881
2019/0387368 A1 12/2019 Sachs et al.

OTHER PUBLICATIONS

"Astro 25 Two-Way Radios At A Glance Safety Redefined" Motorola Solutions, Inc., 2016 (16 pages).
International Search Report and Written Opinion for Application No. PCT/US2021/028640 dated Jul. 28, 2021 (14 pages).

* cited by examiner

*Primary Examiner* — Disler Paul
(74) *Attorney, Agent, or Firm* — Michael Best & Friedrich LLP

(57) ABSTRACT

A method and apparatus for processing audio signals. One system includes a communication device including a transceiver configured to send and receive audio data, and a microphone configured to convert sound waves to a first audio signal. A speaker is configured to convert received electrical signals to an acoustic output and is configured to convert sound waves to a second audio signal. An electronic processor connected to the microphone and the speaker is configured to receive the first audio signal from the microphone, receive the second audio signal from the speaker, determine a correlation value between the first audio signal and the second audio signal, and compare the correlation value to a correlation threshold. In response to the correlation value being below the correlation threshold, the electronic processor generates an output signal based on the first audio signal and the second audio signal, and transmits the output signal.

16 Claims, 10 Drawing Sheets

SPEAKER-AS-MICROPHONE FOR WIND NOISE REDUCTION

BACKGROUND OF THE INVENTION

Communication devices, such as two-way radios or land mobile radios, are used in many applications by public safety and other organizations. Each communication device may include one or more microphones to capture audio from a user for transmission to other communication devices, and one or more speakers to convey audio messages to the user that are received from the other communication devices.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
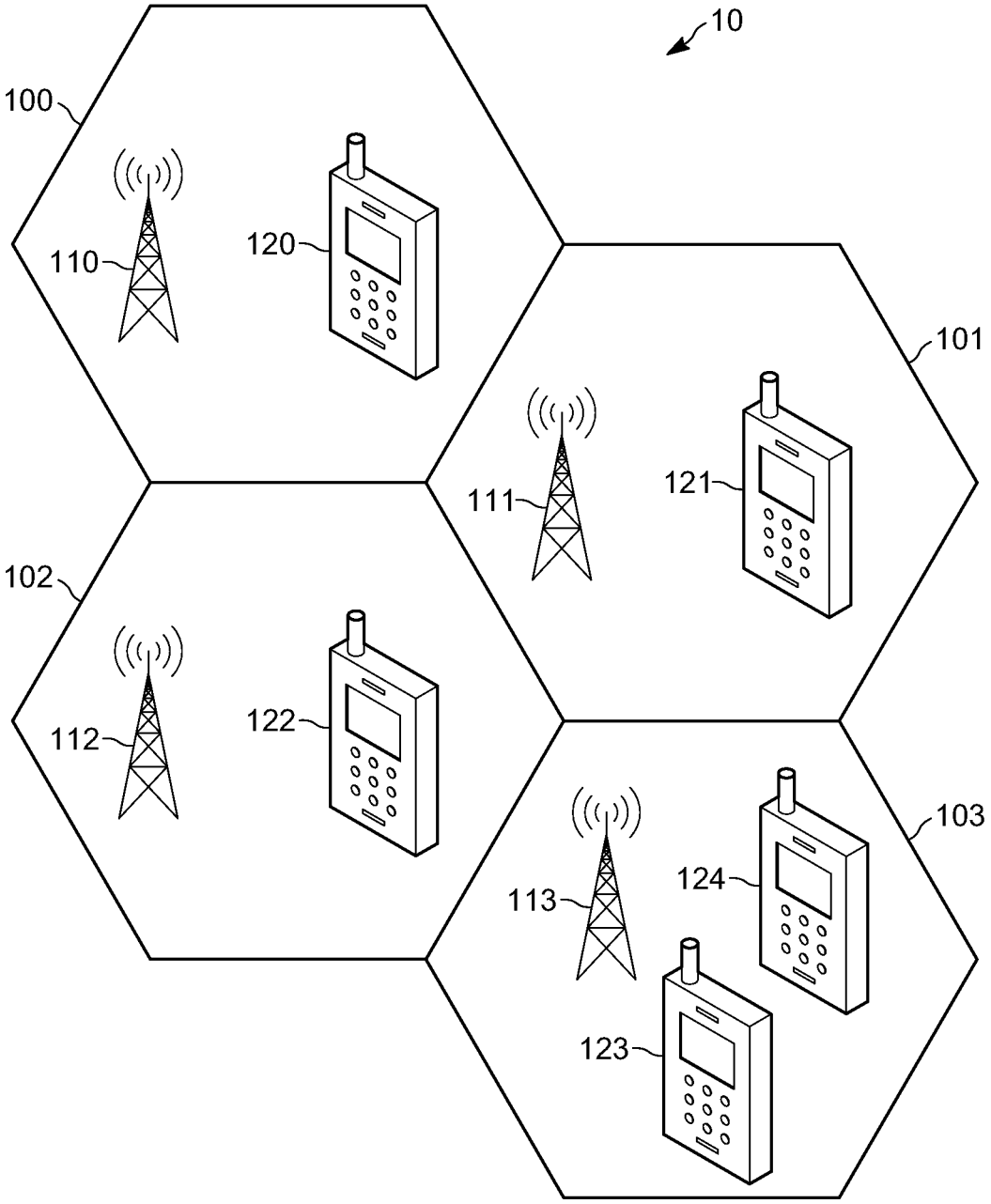
FIG. 1 is a system diagram of a communication system in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

As noted above, communication devices, may include one or more microphones and one or more speakers to capture and convey audio messages between communication devices. However, these communication devices are often used in outdoor environments where environmental factors such as wind and rain create noise in audio signals. Noise impacts the quality of a message being transmitted, and may impair the recipient's ability to understand the message.

While adding microphones can be used to reduce noise in captured audio, additional microphones add costs and increase the size of communication devices. Accordingly, there is a need to remove or mitigate noise from audio messages in communication devices to provide clearer communications, and to do so without adding cost or increasing the size of the communication devices.

Among other things, some embodiments provided herein enable the reduction of noise in communication devices without the addition of further microphones or speakers. For example, in some embodiments, both a microphone and a speaker are used to capture audio, and the resulting audio signals are analyzed to detect the presence of noise, such as produced by wind. When noise is present, the communication device may switch to rely on the speaker (in part or in whole) as a microphone to capture audio for communications because it may be more resistant to noise-producing elements, such as wind. When noise is not present, the communication device may rely on the microphone to capture audio for communications, as the microphone may have better performance due to an inherent noise floor, an acoustic overload point, a signal-to-noise radio, or the like.

One embodiment provides a communication device for processing audio signals. The communication device includes a transceiver configured to send and receive audio data, a microphone configured to convert sound waves to a first audio signal, and a speaker configured to convert received electrical signals to an acoustic output and configured to convert sound waves to a second audio signal. The communication device also includes an electronic processor connected to the microphone and the speaker. The electronic processor is configured to receive the first audio signal from the microphone and receive the second audio signal from the speaker. The electronic processor is further configured to determine a correlation value between the first audio signal and the second audio signal, and compare the correlation value to a correlation threshold. In response to the correlation value being below the correlation threshold, the electronic processor is configured to generate an output signal based on the second audio signal, and transmit, via the transceiver, the output signal.

Another embodiment provides a method for processing audio signals. The method includes receiving, with an electronic processor, a first audio signal from a microphone, and receiving, with the electronic processor, a second audio signal from a speaker. The method includes determining, with the electronic processor, a correlation value between the first audio signal and the second audio signal. The method includes comparing the correlation value to a correlation threshold. The method includes, in response to determining the correlation value is below the correlation threshold, generating, by the electronic processor, an output signal based on the second audio signal, and transmitting, by the electronic processor, the output signal via a transceiver.

FIG. 1 is a diagram of a communication system 10 according to one embodiment. The communication system 10 includes a first communication cell 100, a second communication cell 101, a third communication cell 102, and a fourth communication cell 103, each indicative of a coverage area (for example, coverage range) of a first communication tower 110, a second communication tower 111, a third communication tower 112, and a fourth communication tower 113, respectively. Each communication tower 110 through 113 may be, for example, a radio or cellular tower, a base station, a repeater, or the like. The communication system 10 also includes a first communication device 120, a second communication device 121, a third communication device 122, a fourth communication device 123, and a fifth communication device 124. The communication devices 120 through 124 may be, for example, mobile radios, push-to-talk-devices, mobile phones, personal digital assistants (PDAs), or similar devices capable of half-duplex communication.

The communication system 10 may be implemented using various existing networks, for example, a cellular network, a Long Term Evolution (LTE) network, a 3GPP compliant network, a 5G network, the Internet, a land mobile radio (LMR) network, a Bluetooth™ network, a wireless local area network (for example, Wi-Fi), a wireless accessory Personal Area Network (PAN), a Machine-to-machine (M2M) autonomous network, and a public switched telephone network. The communication system 10 may also include future developed networks. In some embodiments, the communication system 10 may also implement a combination of the networks mentioned previously herein. In some embodiments, the communication devices 120 through 124 communicate directly with each other using a communication channel or connection that is outside of the communication system 10. For example, the plurality of communication devices 120 through 124 may communicate directly with each other when they are within a predetermined distance from each other, such as the fourth communication device 123 and the fifth communication device 124. In some embodiments, the communication devices 120 through 124 communicate using the respective communication towers 110 through 113 that is in the same communication cell 100 through 103 as the respective communication device 120 through 124. For example, the first communication device 120 may transmit a communication signal to the first communication tower 110, as each are located within the first communication cell 100. The first communication tower 110 may transmit the communication signal to the second communication tower 111. The second communication tower 111 then transmits the communication signal to the second communication device 121, as each are located within the second communication cell 101.

Figure 2A:
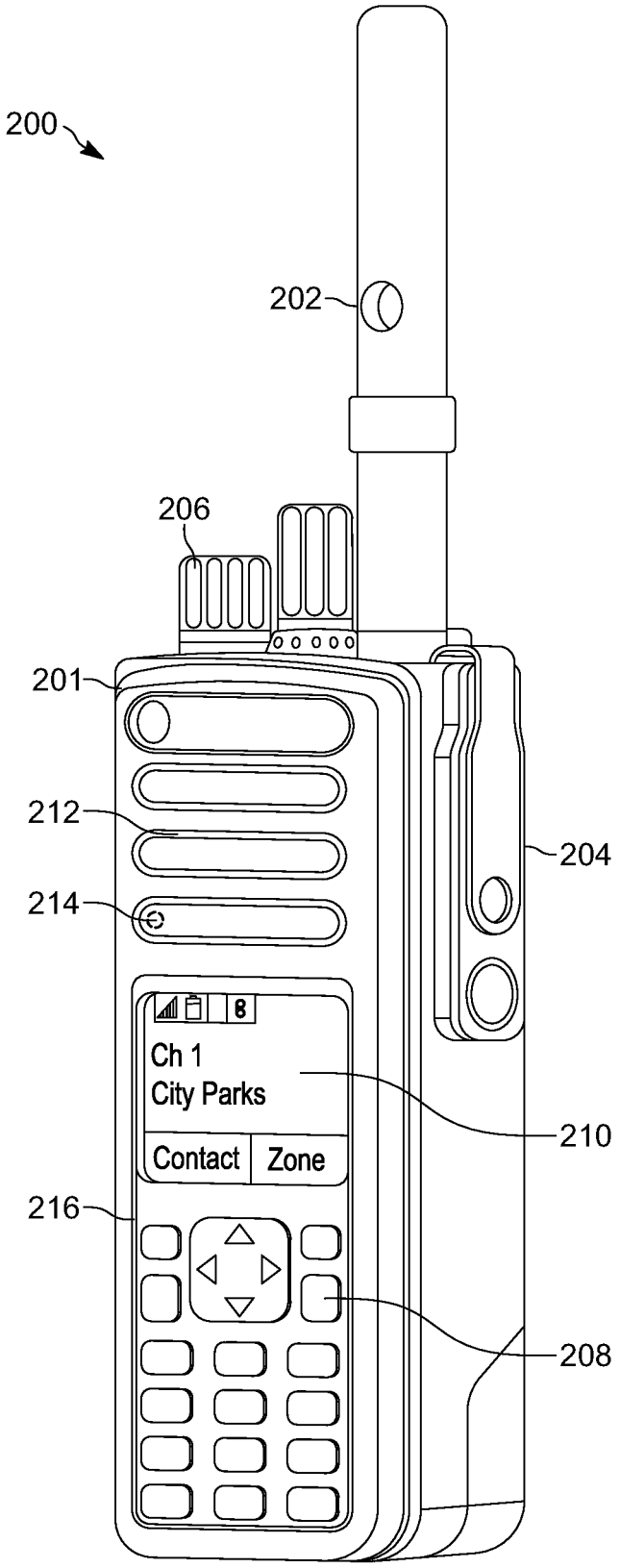
FIGS. 2A-2B are diagrams of a communication device included in the communication system of FIG. 1 in accordance with some embodiments.

FIG. 2A illustrates a communication device 200 of the communication system 10. The communication device 200 may be similar to at least one of the communication devices 120 through 124. The communication device 200 includes a radio housing 201, an antenna 202, a push-to-talk mechanism 204, a frequency tuner 206, a keypad 208, a display 210, a speaker 212 and a microphone 214. The antenna 202 may be configured to transmit and receive audio signals in conjunction with a transceiver 409 (shown in FIG. 4). In some embodiments, the antenna 202 transmits and receives audio signals with the same frequency as set by the frequency tuner 206. The frequency tuner 206 may be, for example, a dial, a switch, a setting changeable with the keypad 208, or the like. The push-to-talk mechanism 204 is configured to allow the communication device 200 to transmit audio signals when activated. The push-to-talk mechanism 204 may be, for example, a push-button, a trigger, a switch, or the like.

In some embodiments, the display 210 is a graphical user interface (GUI) that shows various parameters of the communication device 200. The display 210 may provide, for example, the current battery level of the communication device 200, the current frequency at which the communication device 200 operates, a list of tasks for a user of the communication device 200, an emergency alert, and various other parameters and reports related to the function of the communication device 200. The keypad 208 may allow a user to interact with information shown on the display 210. For example, the keypad 208 may allow a user to enter a status report, transmit alerts to other devices, change the frequency at which the communication device 200 operates, or the like.

In some embodiments, the communication device 200 is capable of half-duplex communication. For example, the push-to-talk mechanism 204 may control an operating mode of the communication device 200. When the push-to-talk mechanism 204 is compressed, the communication device 200 may enable the microphone 214 and disable the ability of the speaker 212 to provide an acoustic output, entering a transmission mode. In the transmission mode, the microphone 214 may be configured to convert sound waves to a digital audio signal (for example, a first audio signal). In some embodiments, when the communication device 200 is in the transmission mode, the speaker 212 is also configured to function as a microphone and convert sound waves to a digital audio signal (for example, a second audio signal). When the speaker 212 is converting sound waves to a digital audio signal, the speaker 212 may be in a speaker-as-mic mode. In some embodiments, when the push-to-talk button is released or relaxed, the communication device 200 may disable the microphone 214 and enable the speaker 212, entering a receiving mode. In the receiving mode, the speaker 212 may be configured to convert electrical signals received using the antenna 202 to an acoustic output.

Figure 2B:
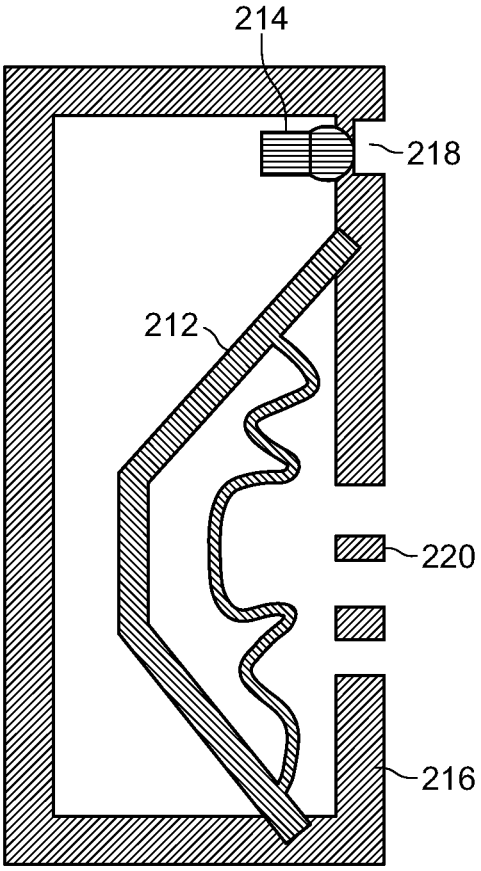

In some embodiments, the speaker 212 and the microphone 214 are situated at a first face 216 of the radio housing 201 (for example, a front face, a user-facing face, or the like). For example, as illustrated in FIG. 2B, the microphone 214 may be located within the radio housing 201 behind an opening 218 in the first face 216. In some embodiments, the microphone 214 may be located within or on the first face 216 of the radio housing 201. The radio housing 201 further include a microphone grill or screen covering the opening 218. In some embodiments, the speaker 212 is located in a speaker recess at the first face 216 of the radio housing 201. The speaker 212 may include a speaker grill 220 covering the speaker recess. In some embodiments, the speaker recess, speaker grill 220, and overall structure is larger than the microphone 214 and the opening 218. When the speaker 212 is in the speaker-as-mic mode, the speaker 212 may experience less noise, such as wind-induced noise, when compared to the microphone 214 because of the additional area over which incoming wind is dispersed.

Figure 3A:
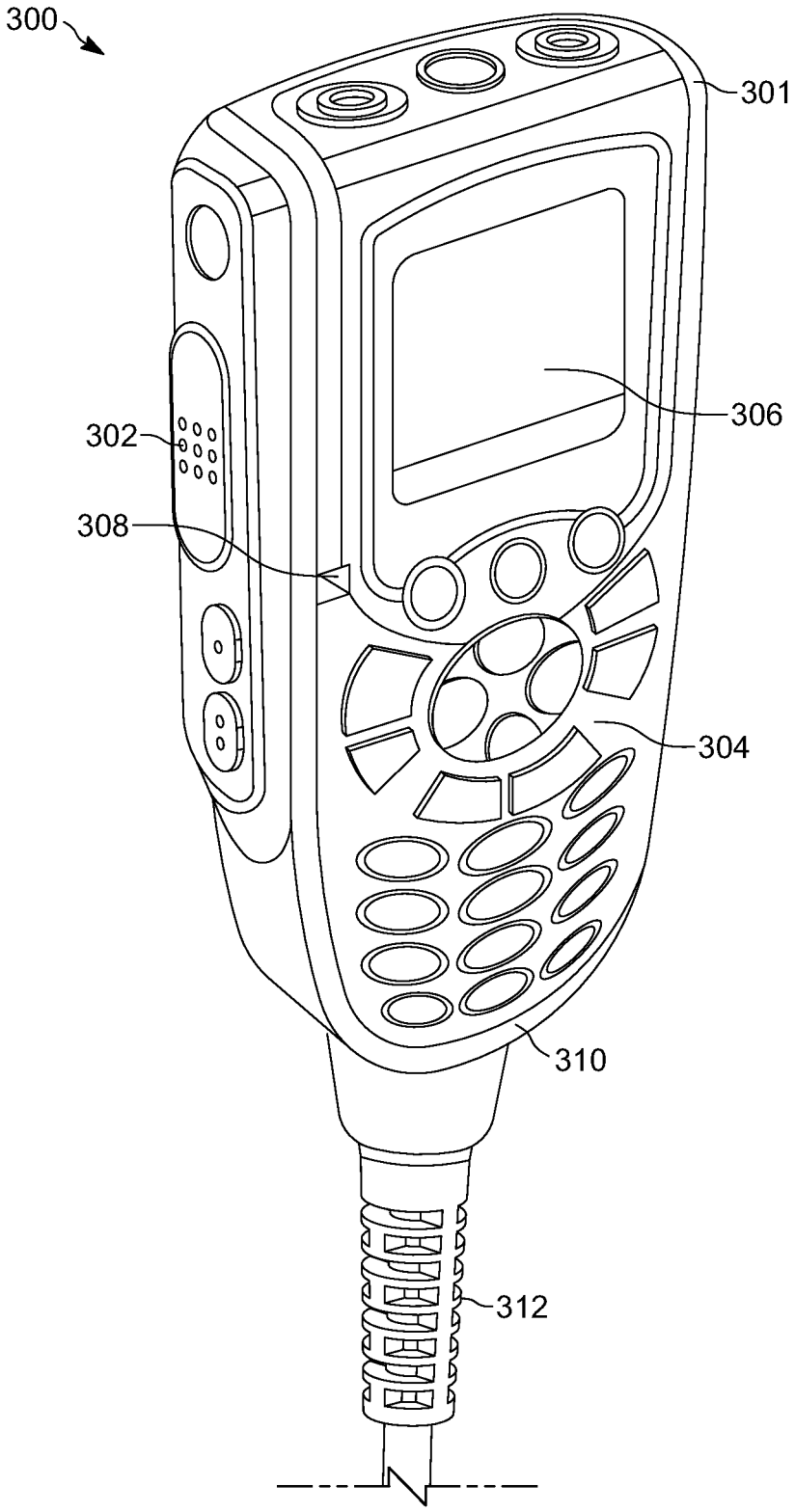
FIG. 3A-3B are diagrams of an accessory compatible with the communication device of FIG. 2 in accordance with some embodiments.

FIG. 3A illustrates an accessory 300 compatible with the communication device 200 according to some embodiments. The accessory 300 includes an accessory housing 301, an accessory push-to-talk mechanism 302, an accessory keypad 304, an accessory display 306, an accessory speaker 308, an accessory microphone 310, and a connector cable 312. The accessory push-to-talk mechanism 302, the accessory keypad 304, and the accessory display 306 may function similarly to the push-to-talk mechanism 204, the keypad 208, and the display 210, respectively. The connector cable 312 may allow the accessory 300 to be selectively coupled to the communication device 200. In some embodiments, when the accessory 300 is coupled to the communication device 200 by the connector cable 312, the accessory 300 receives and transmits audio signals using the antenna 202 of the communication device 200.

Figure 3B:
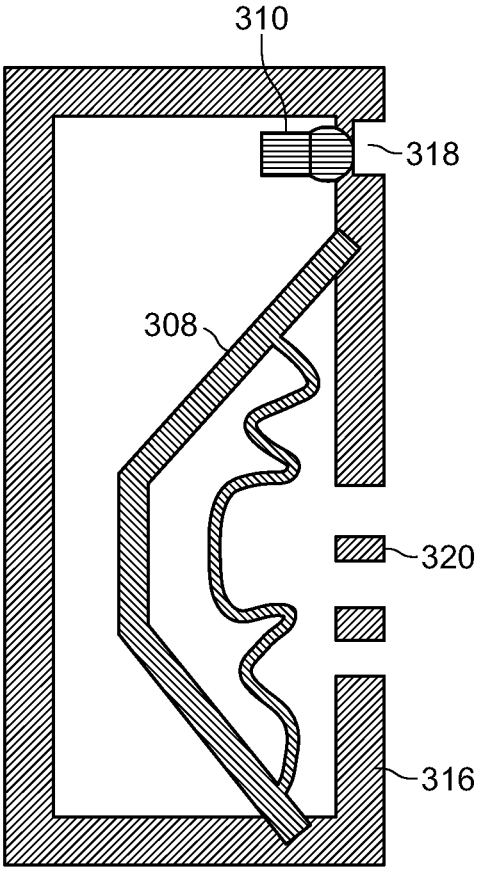

The accessory microphone 310 may be configured to convert sound waves to a digital audio signal (for example, a third audio signal). The accessory speaker 308 may be configured to convert received electrical signals to an acoustic output (for example, a second acoustic output), and may be configured to convert sound waves to a digital audio signal (for example, a fourth audio signal). The accessory speaker 308 and the accessory microphone 310 may be housed on or within the accessory housing 301. In some embodiments, the accessory speaker 308 and the accessory microphone 310 are situated at an accessory first face 316 of the accessory housing 301 (for example, a user-facing face, a front face of the accessory 300, and the like). For example, as illustrated in FIG. 3B, the accessory microphone 310 may be located within the accessory housing 301 behind an accessory opening 318 in the accessory first face 316. The accessory housing 301 may further include an accessory microphone grill or screen covering the accessory opening 318. In some embodiments, the accessory speaker 308 is be located in an accessory speaker recess at the accessory first face 316 of the accessory housing 301. The accessory speaker 308 may further include an accessory speaker grill 320 covering the accessory speaker recess. In some embodiments, the accessory speaker recess, accessory speaker grill 320, and overall structure is larger than the accessory microphone 310 and the accessory opening 318. When the accessory speaker 308 is in the speaker-as-mic mode, the accessory speaker 308 may experience less noise, such as wind-induced noise, when compared to the accessory microphone 310 because of the additional area over which incoming wind is dispersed.

Figure 4A:
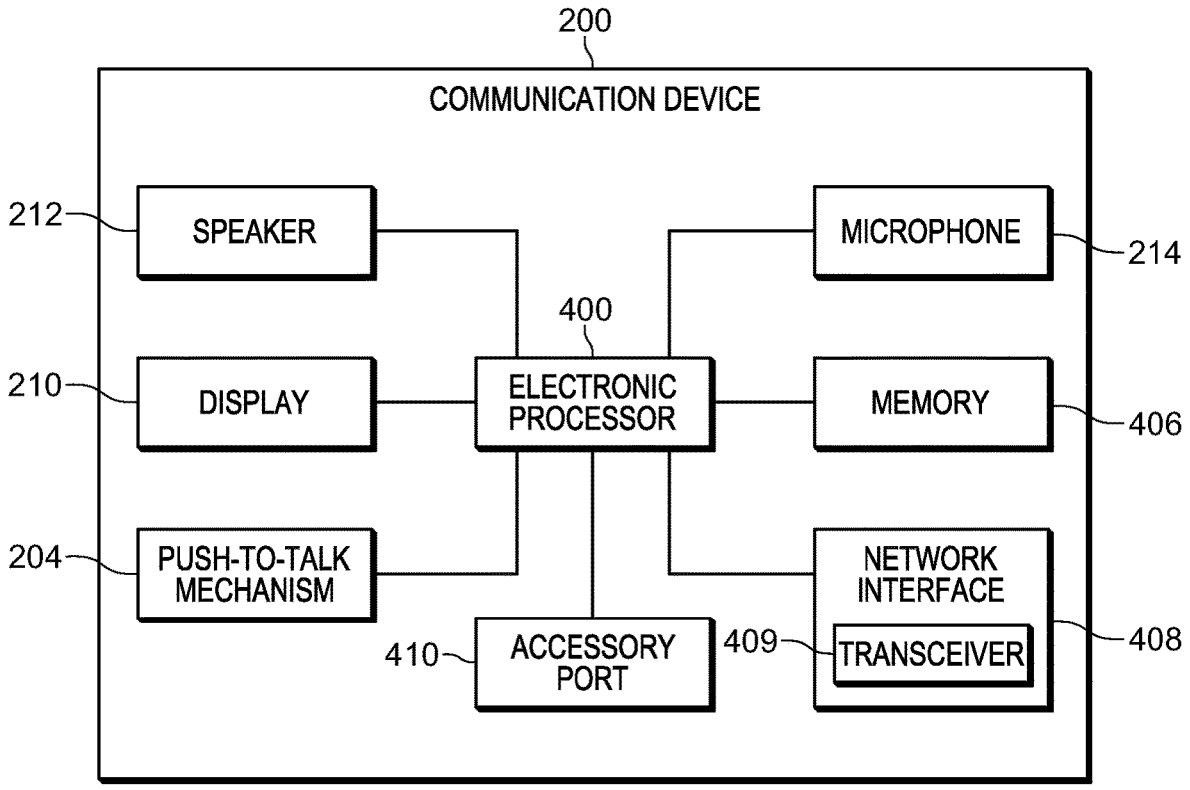
FIG. 4A-4B are block diagrams of the communication device of FIG. 2 in accordance with some embodiments.

FIG. 4 is a block diagram of the communication device 200 of the communication system 10 according to one embodiment. In the example shown, the communication device 200 includes an electronic processor 400 (for example, a microprocessor or another electronic device). The electronic processor 400 may be electrically connected to the speaker 212, the microphone 214, the display 210, the push-to-talk mechanism 204, a memory 406, a network interface 408, and an accessory port 410. In some embodiments, the communication device 200 may include fewer or additional components in configurations different from that illustrated in FIG. 4. For example, in some embodiments, the communication device 200 also includes a camera and a location component (for example, a global positioning system receiver). In some embodiments, the communication device 200 performs additional functionality than the functionality described below.

The memory 406 includes read only memory (ROM), random access memory (RAM), other non-transitory computer-readable media, or a combination thereof. The electronic processor 400 is configured to receive instructions and data from the memory 406 and execute, among other things, the instructions. In particular, the electronic processor 400 executes instructions stored in the memory 406 to perform the methods described herein. In some embodiments, the electronic processor 400 and the memory 406 may collectively be referred to as a microcontroller or electronic controller.

The network interface 408 sends and receives data to and from components of the communication system 10. For example, the network interface 408 may include a transceiver 409 for wirelessly communicating with components of the communication system 10 using the antenna 202. Alternatively or in addition, the network interface 408 may include a connector or port to establish a wired connection to components of the communication system 10. The electronic processor 400 receives electrical signals representing sound from the microphone 214 and may communicate information related to the electrical signals over communication system 10 through the network interface 408. The information may be intended for receipt by another communication device 200. Similarly, the electronic processor 400 may output data received from components of the communication system 10 through the network interface 408, for example, as from another communication device 200, through the speaker 212, the display 210, or a combination thereof. Additionally, the electronic processor 400 may receive electrical signals representing sound from the speaker 212 when the speaker 212 functions as a speaker-as-mic, as described in more detail below.

In some embodiments, the communication device 200 may be coupled to the accessory 300 when the connector cable 312 is inserted into the accessory port 410. When coupled to the accessory 300, the electronic processor 400 may identify the accessory speaker 308 and the accessory microphone 310 and use these to perform functions similar to speaker 212 and the microphone 214.

Figure 4B:
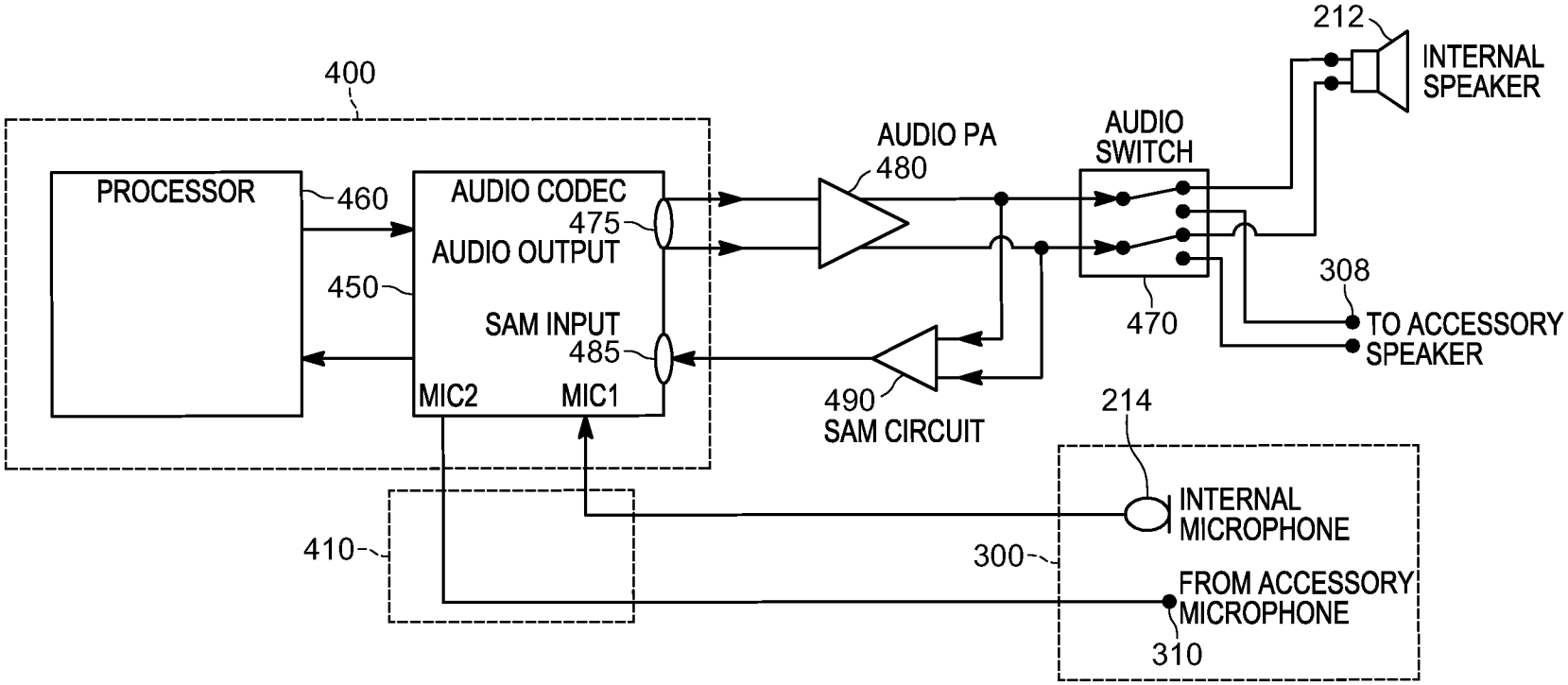

FIG. 4B is circuit diagram illustrating one example of the connections between the electronic processor 400, the speaker 212, the microphone 214, and the accessory 300. In FIG. 4B, the electronic processor 400 is illustrated as including an audio codec 450 and a processor 460. In some embodiments, however, the audio codec 450 and processor 460 are a single device making up the electronic processor 400. In some embodiments, when the accessory 300 is connected to the communication device 200, the audio codec 450 receives the microphone 214, the accessory microphone 310, the speaker 212, and the accessory speaker 308 as separate inputs and outputs. The electronic processor 400 may also switch between the inputs using an audio switch 470. The audio switch 470 may be controlled by the electronic processor 400 when the communication device 200 receives the accessory 300 (for example, automatically switching to the accessory microphone 310 and the accessory speaker 308 when the accessory 300 is received). In some embodiments, the electronic processor 400 may control the audio switch 470 based on a user input, such as a user changing a setting, controlling a physical switch, or the like.

The audio codec 450 (and, thus, the electronic processor 400) includes an audio output port 475 that is coupled to an audio out amplifier 480, which is connected to an input of the audio switch 470. Thus, when the audio codec 450 is outputting an audio signal, the audio signal is amplified by the audio out amplifier 480 and provided, via the audio switch 470, to either the speaker 212 or the accessory speaker 380, depending on the state of the audio switch 470, to provide an acoustic output. Additionally, the audio codec 450 (and thus, the electronic processor 400) includes a speaker-as-mic input port 485 that is coupled to the output of an audio input amplifier 490, which is connected to an output of the audio switch 470. Thus, when speaker 212 or accessory speaker 308 are functioning as a microphone, the audio signal output from the speaker 212 or accessory speaker 308 is provided to the audio switch 470, which is then provided to the audio codec 450 via the audio input amplifier 490.

Figure 5:
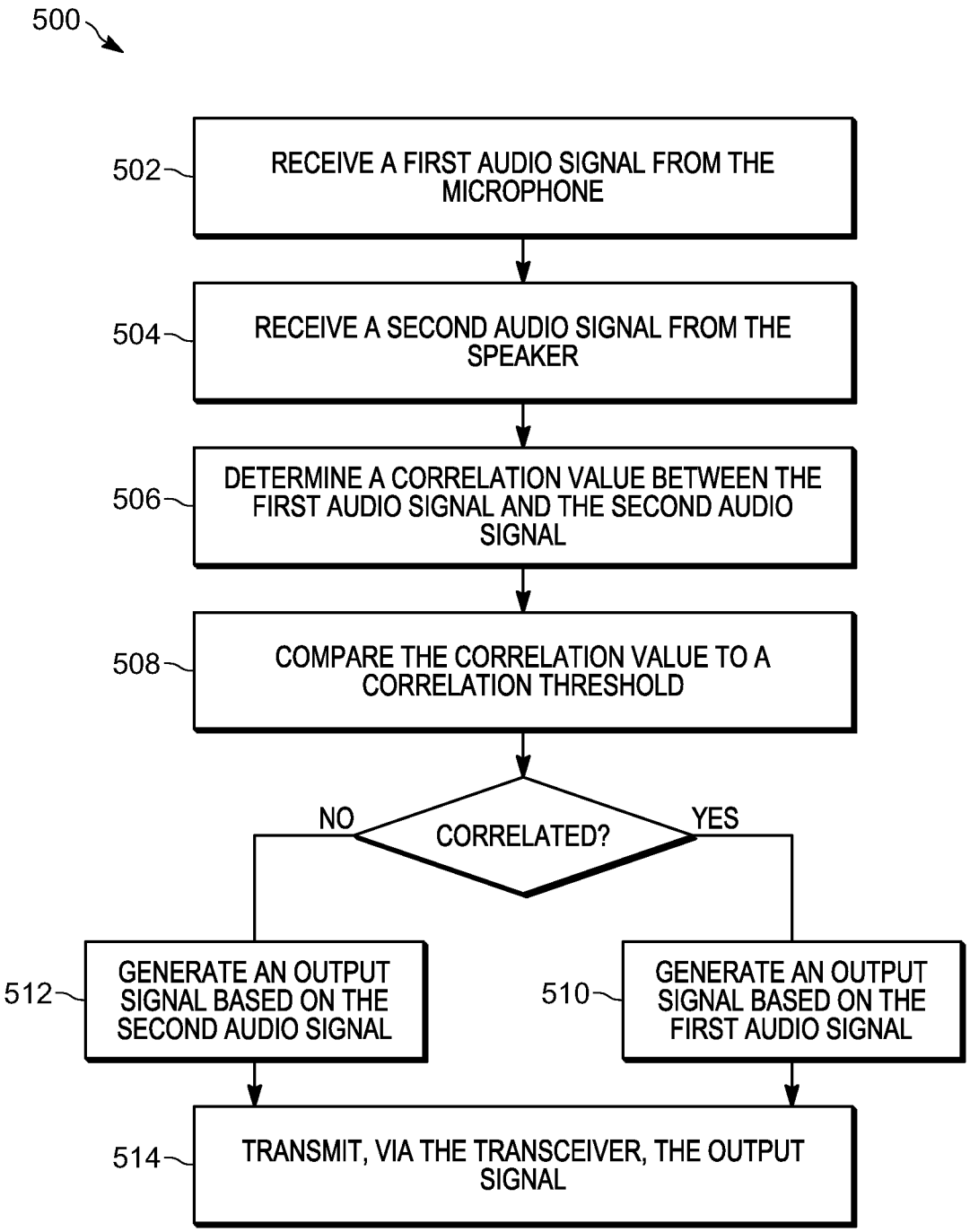
FIG. 5 is a flowchart of a method of reducing noise in a transmission by communication devices in accordance with some embodiments.

FIG. 5 illustrates a flowchart of a method 500 for reducing noise in a transmission by the communication device 200. The method 500 is described as being executed by the electronic processor 400. However, in some embodiments, the method 500 is performed by another device (for example, another electronic processor external to the communication device 200 or an electronic processor of the accessory 300.)

At block 502, the electronic processor 400 receives a first audio signal from the microphone 214. For example, a user of the communication device 200 may push the push-to-talk mechanism 204, placing the communication device 200 in the transmission mode. While in the transmission mode, the microphone 214 receives sound waves (for example, sounds waves generated by a user speaking and by other sound producing elements in the environment of the communication device 200). The microphone 214 converts the received sound waves into the first audio signal. The first audio signal is transmitted from the microphone 214 to the electronic processor 400. The first audio signal may thus characterize or represent words spoken by the user, background noise experienced by the microphone 214 (for example, wind, rain, traffic, and the like), or some combination.

At block 504, the electronic processor 400 receives a second audio signal from the speaker 212. For example, while in the transmission mode, the speaker 212 experiences sound waves and converts the sound waves into the second audio signal. The second audio signal is transmitted from the speaker 212 to the electronic processor 400. The second audio signal may be similar to that of the first audio signal in that it may also characterize or represent the same words spoken by the user, background noise experienced by the speaker 212 (for example, wind, rain, traffic, and the like), or some combination. In some embodiments, however, the second audio signal has less noise than the first audio signal because, as noted above, the physical construction and arrangement of the speaker is such that certain noise (e.g., caused by wind) is mitigated or reduced relative to the microphone 214 and, accordingly, such noise forms less of a part of the second audio signal than the first audio signal.

At block 506, the electronic processor 400 determines a correlation value between the first audio signal and the second audio signal. As described above, due to additional area, second audio signals from the speaker 212 may include less wind-induced noise than first audio signals from the microphone 214. When wind is present in the system, noise is included in first audio signals received by the electronic processor 400. As wind increases, and more noise is present, the first audio signal begins to vary from the second audio signal, resulting in the first audio signal and the second audio signal becoming uncorrelated (for example, as the values of the first audio signal become noisy, the first audio signal and the second audio signal appear less similar to each other). Accordingly, the level of correlation between the first and second audio signals is inversely proportional to the amount of noise present on the first audio signal. In other words, the more noise on the first audio signal from the microphone 214, the more uncorrelated the first audio signal (from the microphone 214) and second audio signal (from the speaker 212) will be.

In some embodiments, determining the correlation value includes calculating the correlation coefficient between the first audio signal and the second audio signal. The correlation coefficient may be determined based on the convolution of the first audio signal and the second audio signal, as shown in Equation 1:

$$X(t) = \sum_{k=0}^{n} m(t-k) * s(t-k)$$

where m(t) is the first audio signal from the microphone 214, s(t) is the second audio signal from the speaker 212, X(t) is the correlation coefficient, and n is a window length.

In some embodiments, determining the correlation value further includes normalizing the correlation coefficient. For example, the correlation coefficient is normalized based on the first audio signal and the second audio signal, as shown in Equation 2:

$$x(t) = X(t) \Big/ \sqrt{\sum_k m(t-k)^2} \Big/ \sqrt{\sum_k s(t-k)^2}$$

where x(t) is the normalized correlation.

In some embodiments, determining the correlation value further includes determining at least one selected from a group consisting of the covariance of the first audio signal and the second audio signal, the average level of the cross spectrum of the first audio signal and the second audio signal, and a root-mean-square deviation of the first audio signal and the second audio signal.

At block 508, the electronic processor 400 compares the correlation value to a correlation threshold. For example, the normalized correlation is compared to a correlation threshold. In some embodiments, each value of the normalized correlation is compared to the correlation threshold. If each value of the normalized correlation is below the correlation threshold, the first audio signal and the second audio signal are uncorrelated, and the electronic processor 400 proceeds to block 512. If each value of the normalized correlation is above the correlation threshold, the first audio signal and the second audio signal are correlated, and the electronic processor 400 proceeds to block 510. In some embodiments, the electronic processor 400 determines how many values of the normalized correlation are above the correlation threshold. If a predetermined number of values are above the correlation threshold, the electronic processor 400 determines the first audio signal and the second audio signal are correlated, and proceeds to block 510. Alternatively, if a predetermined number of values are below the correlation threshold, the electronic processor 400 determines the first audio signal and the second audio signal are uncorrelated, and proceeds to block 512. In some embodiments, the average of the normalized correlation is compared to the correlation threshold. If the average of the normalized correlation is below the correlation threshold, the first audio signal and the second audio signal are uncorrelated, and the electronic processor 400 proceeds to block 512. If the average of the normalized correlation is above the correlation value, the first audio signal and the second audio signal are correlated, and the electronic processor 400 proceeds to block 510.

At block 510, the electronic processor 400 generates an output signal based on the first audio signal from the microphone 214. In some embodiments, the output signal is the first audio signal. In other embodiments, the first audio signal is conditioned to generate the output signal. Conditioning the first audio signal may include using a highpass filter, a lowpass filter, a band-pass filter, normalizing the first audio signal, amplifying the first audio signal, attenuating the first audio signal, or other signal conditioning techniques. However, in block 510, the second audio signal generated by the speaker 212 is not a component part of or used to generate the output signal. Rather, since the first and second audio signals were judged to be correlated, the first audio signal is presumed to have low noise and the electronic processor 400 may generate the output signal based on the first audio signal independent of (i.e., without use of) the second audio signal.

At block 512, the electronic processor 400 generates an output signal based on the second audio signal from the speaker 212. In some embodiments, the output signal is the second audio signal. In other embodiments, the second audio signal is conditioned to generate the output signal. Conditioning the second audio signal may include using a high-pass filter, a lowpass filter, a band-pass filter, normalizing the second audio signal, amplifying the second audio signal, attenuating the second audio signal, or other signal conditioning techniques. However, in some embodiments, in block 512, the first audio signal generated by the microphone 214 is not a component part of or used to generate the output signal. Rather, since the first and second audio signals were judged to be uncorrelated, the first audio signal is presumed to have noise, and the electronic processor 400 may generate the output signal based on the second audio signal independent of (i.e., without use of) the first audio signal.

In some embodiments, however, in block 512, the first audio signal and the second audio signal may be mixed such that the output signal is based on the second audio signal and also based on the first audio signal. In some embodiments, the first audio signal and the second audio signal are evenly mixed. In other words, the electronic processor 400 may generate the output signal by mixing 50% of the first audio signal with 50% of the second audio signal. In some embodiments, the electronic processor 400 mixes the first audio signal and the second audio signal based on a weighted function to generate the output signal. For example, the electronic processor 400 may generate the output signal by mixing 25% of the first audio signal with 75% of the second audio signal.

In some embodiments, the weighted function is based on the correlation value. For example, the normalized correlation value may determine a frequency-dependent mixing weight, given by Equation 3:

$$w(f,t)=G(x(t),f)$$

where w(f,t) is the mixing weight, G(x,f) is a monotonically increasing function that gradually indicates how much of the first audio signal should be mixed, and x(t) is the normalized correlation. When the first audio signal and the second audio signal are completely correlated, x(t) is 1, and w(f,t) also equals 1. This correlation results in the output signal being generated (in block 510) purely from the first audio signal (i.e., without the second audio signal being a component part of the output signal). In some embodiments, when the first audio signal and the second audio signal are completely uncorrelated, x(t) is 0, and w(f,t) also equals 0. This lack of correlation results in the output signal being generated (in block 512) purely from the second audio signal (i.e., without the first audio signal being a component part of the output signal). When the first and second audio signals are deemed uncorrelated after the comparison in block 508, but the first and second audio signals are not completely uncorrelated (i.e., x(t)>0), the electronic processor 400 generates the output signal (in block 512) based on both the first and the second audio signals according to the mixing weight w(f,t), which is a percentage between 0-100% that increases proportionally to the amount of correlation between the signals. Even when mixed, the output signal may also be conditioned in a similar manner as described above. In some embodiments, a high-pass filter is applied to the first audio signal prior to mixing to remove noise from the first audio signal.

In some embodiments, to generate the output signal, the electronic processor 400 may mix the first audio signal and the second audio signal based on the frequency at which wind noise in the first audio signal is prevalent. For example, when determining the correlation between the first audio signal and the second audio signal, the electronic processor 400 may identify a frequency range at which a high level of wind noise exists (for example, a noisy frequency). The electronic processor 400 may then remove the values of the first audio signal at the noisy frequency. In some embodiments, the electronic processor 400 reduces the mixing weight of the first audio signal in the noisy frequency. In some embodiments, the electronic processor 400 divides the frequency spectra of the first audio signal and the second audio signal into a series of frequency ranges (for example, frequency bins). For each frequency range, the mixing weight of the first audio signal with the second audio signal may be determined based on the correlation value for that specific frequency range. The generated output signal then includes the composite of the mixed signals for the series of frequency ranges.

At block 514, the electronic processor 400 transmits, with the transceiver 409, the output signal. The output signal may then be received by another communication device in the communication system 10, where the output signal may be stored in a memory, converted into an acoustic output by a processor and speaker of the receiving device, or transmitted on to another device.

Figure 6A:
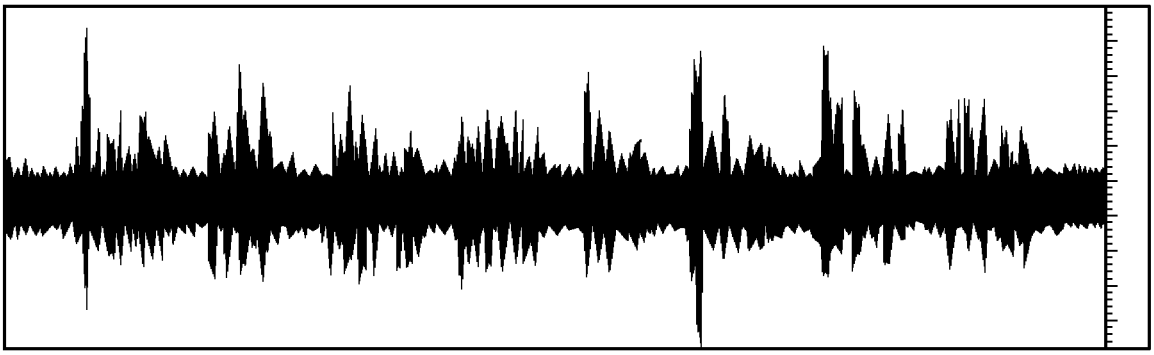
FIGS. 6A-6C are audio signals received and transmitted by the electronic processor of FIG. 4 in accordance with some embodiments.
Figure 6B:
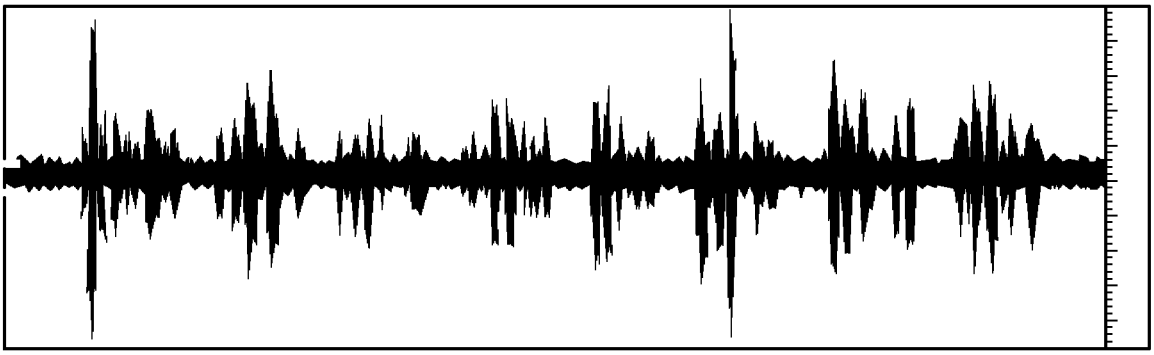
Figure 6C:
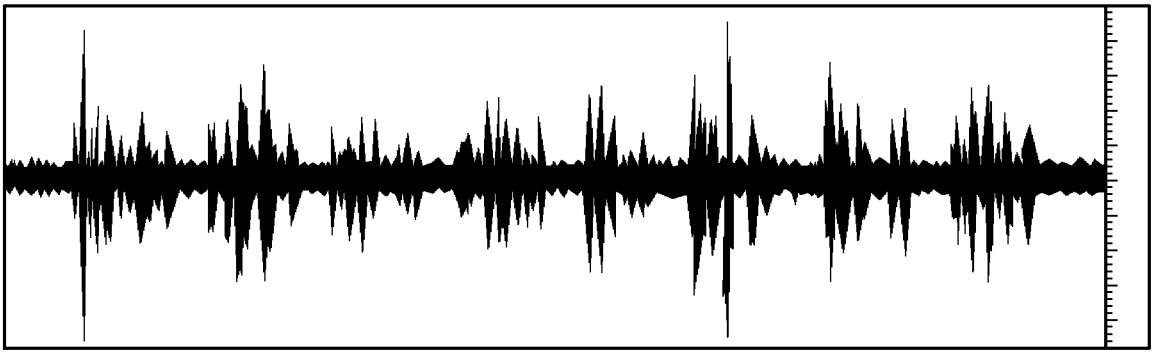

FIGS. 6A-6C illustrate example audio signals that may be received by or transmitted by the electronic processor 400. FIG. 6A provides an example first audio signal transmitted by the microphone 214 to the electronic processor 400. The first audio signal includes wind noise and has an increased root-mean-square level. FIG. 6B provides an example second audio signal transmitted by the speaker 212 to the electronic processor 400. The second audio signal has significantly less noise than the first audio signal due to the respective speaker and microphone characteristics previously noted. FIG. 6C provides an example of an output signal. As illustrated, the output signal is a mix of the first audio signal and the second audio signal.

In some embodiments, the electronic processor 400 may determine the first audio signal received by the microphone 214 has little noise present prior to determining the correlation between the first audio signal and the second audio signal. For example, the electronic processor 400 may calculate a root-mean-square (RMS) level of the first audio signal upon receiving the first audio signal. The root-mean-square level of the first audio signal may then be compared to a threshold. If the root-mean-square level is below the threshold, the electronic processor may generate the output signal based purely on the first audio signal, as described above, without determining the correlation between the first audio signal and the second audio signal (i.e., bypassing one or more of blocks 504, 506, and 508, and proceeding to block 510).

Figure 7:
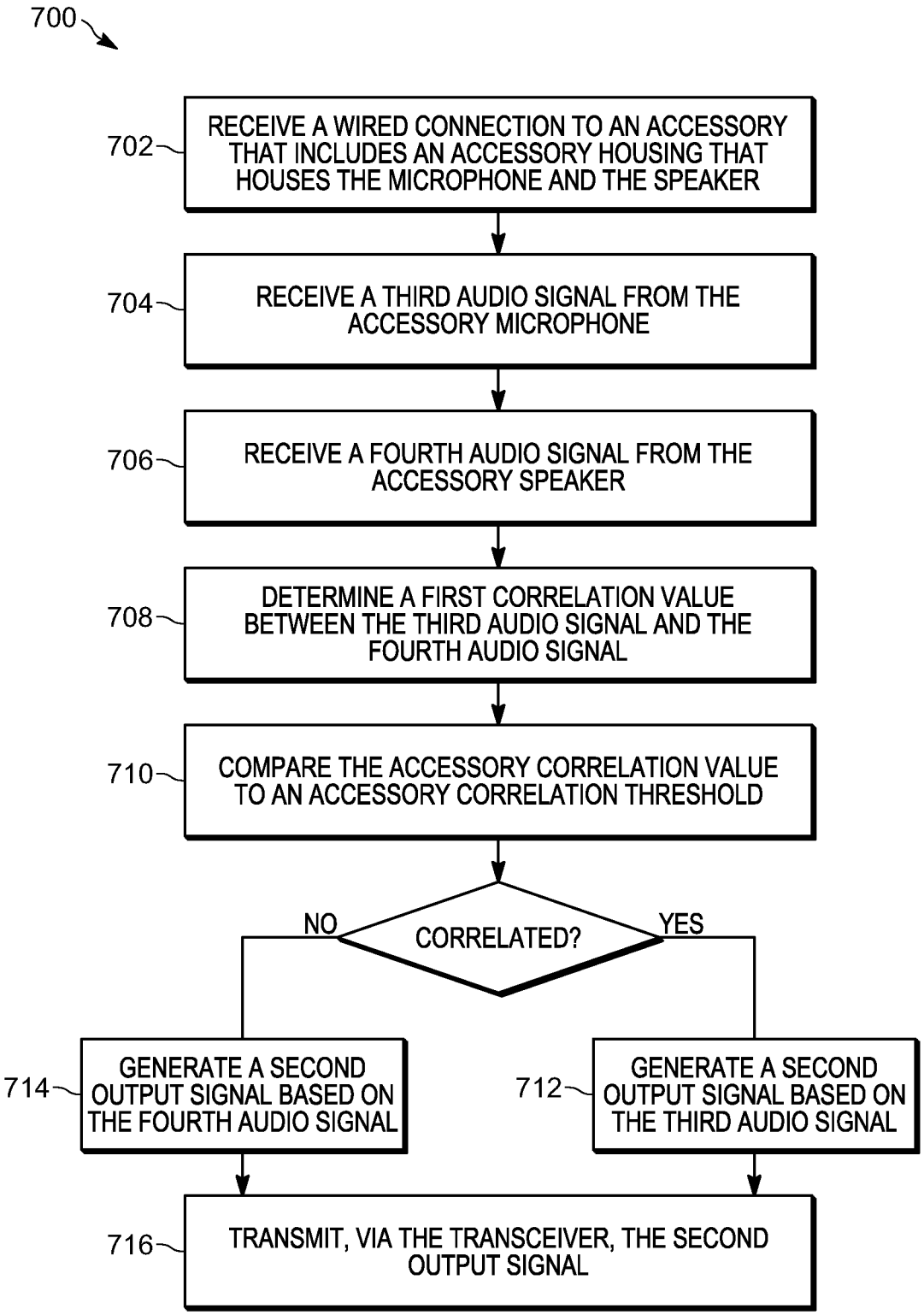
FIG. 7 is a flowchart of a method of reducing noise in a transmission by communication devices using accessories in accordance with some embodiments.

FIG. 7 illustrates a flowchart of a method 700 for reducing noise in a transmission by the communication device 200 using the accessory 300. The method 700 is described as being executed by the electronic processor 400. However, in some embodiments, the method 700 is performed by another device (for example, another electronic processor external to the communication device 200 or an electronic processor of the accessory 300.)

At block 702, the electronic processor 400 receives, with the accessory port 410, a wired connection to the accessory 300 that includes the accessory housing 301 that houses the accessory microphone 310 and the accessory speaker 308. For example, the accessory 300 is coupled to the communication device 200 with the connector cable 312.

At block 704, the electronic processor 400 receives third audio signal from the accessory microphone 310. For example, a user of the accessory 300 may push the accessory push-to-talk mechanism 302, placing the accessory 300 in the transmission mode. While in the transmission mode, the accessory microphone 310 receives sound waves (for example, sound waves generated by a user speaking and by other sound producing elements in the environment of the accessory 300). The accessory microphone 310 converts the received sound waves into the third audio signal. The first audio signal is transmitted from the accessory microphone 310 to the electronic processor 400. The third audio signal may thus characterize or represent words spoken by the user, background noise experienced by the accessory microphone 310 (for example, wind, rain, traffic, and the like), or some combination.

At block 706, the electronic processor 400 receives a fourth audio signal from the accessory speaker 308. For example, while in the transmission mode, the accessory speaker 308 experiences sound waves and converts the sound waves into the fourth audio signal. The fourth audio signal is transmitted from the accessory speaker 308 to the electronic processor 400. The fourth audio signal may be similar to that of the third audio signal in that it may also characterize or represent the same words spoken by the user, background noise experienced by the accessory speaker 308 (for example, wind, rain, traffic, and the like), or some combination. In some embodiments, the fourth audio signal has less noise than the third audio signal because, as noted above, the physical construction and arrangement of the speaker is such that certain noise (e.g., caused by wind) is mitigated or reduced relative to the accessory microphone 310 and, accordingly, such noise forms less of a part of the fourth audio signal than the third audio signal.

At block 708, the electronic processor 400 determines an accessory correlation value between the third audio signal and the fourth audio signal. Determining the accessory correlation value between the third audio signal and the fourth audio signal may be similar to the process performed to determine the correlation value between the first audio signal and the second audio signal. At block 710, the electronic processor 400 compares the accessory correlation value to an accessory correlation threshold in a manner similar to that as discussed for block 508. For example, if the accessory correlation value is below the accessory correlation threshold, the third audio signal and the fourth audio signal are uncorrelated, and the electronic processor 400 continues to block 714. If the accessory correlation value is above the accessory correlation threshold, the third audio signal and the fourth audio signal are correlated, and the electronic processor 400 continues to block 712.

At block 712, the electronic processor 400 generates a second output signal based on the third audio signal from the accessory microphone 310. In some embodiments, the second output signal is the third audio signal. In other embodiments, the third audio signal is conditioned to generate the second output signal. Conditioning the third audio signal may include using a highpass filter, a lowpass filter, a band-pass filter, normalizing the third audio signal, amplifying the third audio signal, attenuating the third audio signal, or other signal conditioning techniques. However, in block 712, the fourth audio signal generated by the accessory speaker 308 is not a component part of or used to generate the second output signal. Rather, since the third and fourth audio signals were judged to be correlated, the third audio signal is presumed to have low noise and the electronic processor 400 may generate the output signal based on the third audio signal independent of (i.e., without use of) the second audio signal.

At block 714, the electronic processor 400 generates a second output signal based on the fourth audio signal from the accessory speaker 308. In some embodiments, the second output signal is the fourth audio signal. In other embodiments, the fourth audio signal is conditioned to generate the output signal. Conditioning the fourth audio signal may include using a highpass filter, a lowpass filter, a band-pass filter, normalizing the fourth audio signal, amplifying the fourth audio signal, attenuating the fourth audio signal, or other signal conditioning techniques. However, in some embodiments, in block 714, the third audio signal generated by the accessory microphone 310 is not a component part of or used to generate the output signal. Rather, since the third and fourth audio signals were judged to be uncorrelated, the third audio signal is presumed to have noise, and the electronic processor 400 may generate the output signal based on the fourth audio signal independent of (i.e., without use of) the third audio signal.

In some embodiments, the third audio signal and the fourth audio signal may be mixed such that the second output signal is based on the fourth audio signal and also based on the third audio signal, as described above with respect to the first audio signal and the second audio signal. At block 716, the electronic processor 400 transmits, via the transceiver 409, the second output signal. The output signal may then be received by another communication device in the communication system 10, where the second output signal may be stored in a memory, converted into an acoustic output by a processor and speaker of the receiving device, or transmitted on to another device.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. For example, it should be understood that although certain drawings illustrate hardware and software located within particular devices, these depictions are for illustrative purposes only. In some embodiments, the illustrated components may be combined or divided into separate software, firmware and/or hardware. For example, instead of being located within and performed by a single electronic processor, logic and processing may be distributed among multiple electronic processors. Regardless of how they are combined or divided, hardware and software components may be located on the same computing device or may be distributed among different computing devices connected by one or more networks or other suitable communication links.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element preceded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A communication device for processing audio signals, the device comprising: a transceiver configured to send and receive audio data; a microphone configured to convert sound waves to a first audio signal; a speaker configured to convert received electrical signals to an acoustic output and configured to convert sound waves to a second audio signal; and an electronic processor connected to the microphone and the speaker, the electronic processor configured to: receive the first audio signal from the microphone; receive the second audio signal from the speaker; determine a correlation value between the first audio signal and the second audio signal; compare the correlation value to a correlation threshold; in response to the correlation value being below the correlation threshold, generate an output signal based on the second audio signal, wherein the electronic processor is further configured to mix the first audio signal and the second audio signal based on a weighted function according to the correlation value to generate the output signal; and transmit, via the transceiver, the output signal.

2. The communication device of claim 1, wherein the electronic processor is further configured to:

in response to the correlation value being above the correlation threshold, generate the output signal based on the first audio signal.

3. The communication device of claim 1, further comprising:

a radio housing including a first face, wherein the microphone is situated at the first face, and wherein the speaker is situated at the first face.

4. The communication device of claim 1, wherein a high-pass filter is applied to the first audio signal.

5. The communication device of claim 1, wherein the communication device communicates over a half-duplex, push-to-talk system.

6. The communication device of claim 1, further comprising:

a radio housing that houses the electronic processor; and an accessory including an accessory housing that is coupled by a wired connection to the radio housing, wherein the accessory housing houses the microphone and the speaker.

7. The communication device of claim 6, wherein the microphone and the speaker are situated at a first face of the accessory housing.

8. The device of claim 1, wherein the electronic processor is configured to be selectively coupled to an accessory including an accessory microphone and an accessory speaker, wherein the accessory microphone is configured to convert sounds waves to a third audio signal, and wherein the accessory speaker is configured to convert received electrical signals to a second acoustic output, and configured to convert sound waves to a fourth audio signal, and wherein the electronic processor is further configured to:

receive the third audio signal from the accessory microphone;

receive the fourth audio signal from the accessory speaker;

determine an accessory correlation value between the third audio signal and the fourth audio signal;

compare the accessory correlation value to an accessory correlation threshold;

in response to the accessory correlation value being below the accessory correlation threshold, generate a second output signal based on the third audio signal and the fourth audio signal; and transmit, via the transceiver, the second output signal.

9. A method for processing audio signals, the method comprising: receiving, with an electronic processor, a first audio signal from a microphone; receiving, with the electronic processor, a second audio signal from a speaker; determining a correlation value between the first audio signal and the second audio signal; comparing the correlation value to a correlation threshold; in response to the correlation value being below the correlation threshold, generating, by the electronic processor, an output signal based on the second audio signal; mixing, by the electronic processor, the first audio signal and the second audio signal based on a weighted function according to the correlation value to generate the output signal; and transmitting, by the electronic processor, the output signal via a transceiver.

10. The method of claim 9, further comprising:

in response to the correlation value being above the correlation threshold, generating an output signal based on the first audio signal.

11. The method of claim 9, further comprising:

applying a high-pass filter to the first audio signal.

12. The method of claim 9, further comprising:

receiving, by a port of a radio housing that houses the electronic processor, a wired connection to an accessory that includes an accessory housing that houses the microphone and the speaker.

13. The method of claim 12, further comprising:

receiving, with the electronic processor, a third audio signal from the accessory microphone;

receiving, with the electronic processor, a fourth audio signal from the accessory speaker;

determining an accessory correlation value between the third audio signal and the fourth audio signal;

comparing the accessory correlation value to an accessory correlation threshold;

in response to the accessory correlation value being below the accessory correlation threshold, generating a second output signal based on the third audio signal and the fourth audio signal; and transmitting, by the electronic processor, the second output signal via the transceiver.

14. The method of claim 9, wherein determining a correlation value between the first audio signal and the second audio signal includes determining at least one selected from a group consisting of a covariance of the first audio signal and the second audio signal, an average level of the cross spectrum of the first audio signal and the second audio signal, and a root-mean-square deviation of the first audio signal and the second audio signal.

15. The method of claim 14, wherein the correlation value is normalized to create a normalized correlation value using the root-mean-square levels of the first audio signal and the second audio signal.

16. The method of claim 15, wherein the normalized correlation value is compared to the correlation threshold.

* * * * *